US010892567B2

(12) United States Patent
Gery et al.

(10) Patent No.: US 10,892,567 B2
(45) Date of Patent: Jan. 12, 2021

(54) CONNECTION DEVICE TO BE CRIMPED ONTO AN END SECTION OF CABLE, COMPRISING A CONDUCTING SHEATH PROVIDED WITH A WALL SEPARATING TWO HOUSINGS

(71) Applicant: MECATRACTION, Arnac Pompadour (FR)

(72) Inventors: Eric Gery, Conceze (FR); Florent Mallet, Vignols (FR)

(73) Assignee: MECATRACTION, Arnac Pompadour (FR)

( * ) Notice: Subject to any disclaimer, the term of this patent is extended or adjusted under 35 U.S.C. 154(b) by 0 days.

(21) Appl. No.: 16/489,043

(22) PCT Filed: Feb. 26, 2018

(86) PCT No.: PCT/FR2018/050452

§ 371 (c)(1),
(2) Date: Aug. 27, 2019

(87) PCT Pub. No.: WO2018/158533

PCT Pub. Date: Sep. 7, 2018

(65) Prior Publication Data

US 2020/0006867 A1 Jan. 2, 2020

(30) Foreign Application Priority Data

Feb. 28, 2017 (FR) ..... 17 51642

(51) Int. Cl.
*H01R 9/03* (2006.01)
*H01R 4/20* (2006.01)
*H01R 11/12* (2006.01)

(52) U.S. Cl.
CPC ..... *H01R 4/20* (2013.01); *H01R 11/12* (2013.01)

(58) Field of Classification Search
CPC ..... H01R 4/20; H01R 11/12; H01R 4/186; H01R 4/203
(Continued)

(56) References Cited

U.S. PATENT DOCUMENTS 3,955,044 A * 5/1976 Hoffman ..... H01R 4/203 174/84 C
4,135,296 A 1/1979 Kami et al.
(Continued)

FOREIGN PATENT DOCUMENTS

DE 102014214416 A1 1/2016
EP 0275344 A1 7/1988
GB 555836 A 9/1943

OTHER PUBLICATIONS

International Search Report, dated Apr. 25, 2018, from corresponding PCT application No. PCT/FR2018/050452.

*Primary Examiner* — Abdullah A Riyami
*Assistant Examiner* — Nelson R. Burgos-Guntin
(74) *Attorney, Agent, or Firm* — Nixon & Vanderhye

(57) ABSTRACT

A connection device includes a conducting element exhibiting a tubular portion and including a conducting sheath which is perforated with distributed perforations according to a predetermined solid-void pattern, the tubular portion and the sheath being configured in such a way that the sheath can be placed inside the tubular portion with the end section positioned inside the sheath and so that the tubular portion and the sheath can then be crimped onto the end section. The sheath includes at least one longitudinal wall separating two distinct housings each configured to accept one respective longitudinal portion of the end section of cable.

20 Claims, 7 Drawing Sheets

(58) Field of Classification Search
USPC ..... 439/879, 877, 880, 882
See application file for complete search history.

(56) References Cited

U.S. PATENT DOCUMENTS

| | | | | |
|---|---|---|---|---|
| 4,317,277 | A | 3/1982 | Bennett et al. | |
| 6,109,984 | A * | 8/2000 | Tsou | H01R 13/432 439/879 |
| 10,424,849 | B2 * | 9/2019 | Staab | H01R 4/203 |
| 2009/0181579 | A1 | 7/2009 | Telakowski et al. | |
| 2014/0134873 | A1 * | 5/2014 | Lehmann | H01R 4/2495 439/421 |

* cited by examiner

CONNECTION DEVICE TO BE CRIMPED ONTO AN END SECTION OF CABLE, COMPRISING A CONDUCTING SHEATH PROVIDED WITH A WALL SEPARATING TWO HOUSINGS

FIELD OF THE INVENTION

The invention relates to connection devices to crimp on an end section of electric cable.

TECHNOLOGICAL BACKGROUND

Such a device is already known, in particular from French patent application 2 947 960, which comprises a conducting member and a one-piece insert. The conducting member has a tubular portion while the one-piece insert comprises a sleeve disposed inside the tubular portion. The sleeve is configured to receive the end section of cable and more specifically the aluminum core of that end section. The sleeve comprises a plurality of perforations and is of a harder material than the aluminum such that the sleeve is able to deform the core of the end section of the cable at the time of crimping the tubular portion and the sleeve onto the core of the end section, which then embeds itself into the perforations of the sleeve.

This connection device is particularly appreciated since it makes it possible to obtain excellent electrical continuity between the connection device and the aluminum core of the cable, in particular because the embedding of the aluminum core in the perforations of the sleeve enables the poorly electrically conducting alumina layer at the surface of the aluminum core to be broken.

SUBJECT OF THE INVENTION

The invention is directed to increasing the possibilities for use of such a connection device, or in any case to improving the performance thereof, while maintaining its simple, convenient and economical character.

To that end the invention provides a connection device to crimp on an end section of electric cable, comprising a conducting member having a tubular portion and comprising a conducting sheath apertured according to a predetermined solid-hollow pattern, said tubular portion and said sheath being configured in order for the sheath to be disposed inside the tubular portion with the end section disposed inside the sheath and in order for the tubular portion and the sheath then to be able to be crimped on the end section; characterized in that the sheath comprises at least one longitudinal wall separating two distinct housings each configured to receive a respective longitudinal portion of said end section of cable.

Contrary to the aforementioned prior connection device of which the sheath is formed by an insert or sleeve delimiting a single housing, in the connection device according to the invention the sheath delimits at least two housings, separated from each other by a longitudinal wall.

The existence of those two distinct housings and of that wall which separates them makes it possible in the connection device according to the invention to have the wall of the apertured sheath not only at the periphery of the sheath but also inside the sheath.

Greater contact area is thus provided between the sheath and the end section of the cable, which is subdivided into at least two portions each disposed in a respective housing.

This is favorable to the performance of the connection device with regard to electrical continuity.

The fact that the wall which separates the two housings has a longitudinal orientation, that is to say the same orientation as the portions of the end section of cable in the device, provides the advantage of maximizing the contact surface area between that wall and the longitudinal portions of the end section of cable.

It will be noted that the conducting sheath of the connection device according to the invention is capable of being implemented in a simple, convenient and economical way, in particular with the advantageous features disclosed below.

It will be noted that the connection device according to the invention is, like the aforementioned prior connection device, suitable for an electric cable with a flexible core of aluminum; and that, surprisingly, the connection device according to the invention is also capable of equipping the end of certain cables for which it was thought that a device of this type would not enable the required electrical continuity to be obtained, for example the cables commonly designated by the name CTC or Continuously Transposed Conductors cables.

It is known that such cables serve to form electrical windings, for example to produce transformers, and that they comprise several conductors each individually insulated, each conductor generally being designated by the name strand. The fact that the cable comprises several conductors insulated from each other makes it possible to limit the increase in impedance of the cable due to the "skin" effect arising when the cable is passed through by a high-frequency current.

At each end of such a cable, it is necessary to link all the conductors to a member from which they must take the potential, for example an input or output terminal of a transformer.

Conventionally, to equip an end of such a cable with a connection device, the different strands are separated from each other (the insulating jacket of the cable is removed) then for each strand the insulating coating is removed, which is in general of enamel. Next, a connection device such as a connecting terminal is soldered or brazed onto the strands from which the insulating coating has been removed.

Such removal of the coating is conventionally made by burning with a flame or by mechanical abrasion, which makes the operations of removing the coating such as enamel particularly difficult and costly.

The invention is based on the observation that, contrary to the general opinion that such a cable having strands each covered with a layer of insulating coating necessarily required prior removal of the insulating coating, it is in fact possible not to carry out that operation.

The invention is also based on the observation that it is possible to mitigate the incompatibility that exists in the general opinion between such a cable with strands each covered by a layer of insulating coating and a connection device to be crimped such as the aforementioned prior device.

As a matter of fact, it has been observed that if the strands of the cable are disposed in the sleeve of a connection device to crimp such as the aforementioned prior device, the parts of the strands in direct contact with the sleeve have their insulating coating broken by the wall of the sleeve on crimping, whereas the parts of the strands in contact with another strand have their insulating coating remain intact.

It will be noted that the observation that the parts of the strands in direct contact with the sleeve have their insulating coating broken by the wall of the sleeve on crimping, was not a matter of course. Indeed, in the strands of a Continuously Transposed Conductors cable, the insulating coating has a thickness which is of an order of magnitude considerably greater than the thickness of the layer of alumina which forms on the conducting core of the aluminum cables, that is to say of the order of a tenth of a millimeter for the thickness of the layer of insulating coating of a material such as enamel and of the order of the nanometer for the layer of alumina. What is more, the alumina is a relatively brittle material, and thus easy to break, whereas an insulating coating of material such as that of enamel is relatively ductile since it must withstand the flexing that occurs when the cable is coiled, without breaking.

The existence of two distinct housings and of the wall which separates them makes it possible in the connection device according to the invention to avoid or in any case to reduce the risk of a strand of the cable being protected from the wall of the sheath by another strand.

According to advantageous features, for reasons of simplicity, convenience and economy of implementation of the connection device according to the invention:

- the sheath comprises at least two said longitudinal walls each forming a sleeve delimiting a said housing, each sleeve neighboring another sleeve in said sheath such that the housing of each sleeve is separated from the housing of the neighboring sleeve by the longitudinal wall of that sleeve and by the longitudinal wall of the neighboring sleeve;
- the sheath comprises a said longitudinal wall forming a structure delimiting the two said housings, which are separated from each other by a portion of said longitudinal wall;
- said longitudinal wall is shaped such that the housings are disposed in at least one row;
- said longitudinal wall is shaped such that the housings are disposed in several adjacent rows;
- each housing extends longitudinally between a first end where the sheath has at least one opening for insertion of the respective longitudinal portion of said end section of cable, and a second end, which is an opposite end to the first end, where the sheath has a stop configured to limit the pushing-in of the longitudinal portion of the end section of cable into the housing;
- said longitudinal wall is a metal sheet that is perforated according to a predetermined pattern, cut out and folded;
- said longitudinal wall is a helically wound metal wire; and/or
- said longitudinal wall is a metal trellis.

The invention is also directed to an assembly comprising a connection device and an electric cable comprising a plurality of strands, each of said two housings of the conducting sheath receiving a respective longitudinal portion of an end section of said electric cable comprising at least one said strand.

According to simple, convenient and economical features of the assembly according to the invention:

- each strand of said electric cable is provided with a core of conducting material and with an insulating coating covering said conducting core such that the strands are electrically insulated from each other, the conducting sheath being formed from a harder conducting material than the material of the insulating coating, and than the conducting material of the core of each strand, such that after crimping of the tubular portion and of the conducting sheath on the end section of the electric cable, for each strand, the core of the strand and the conducting sheath are in direct contact;
- the insulating coating of the strands comprises insulating enamel, whereas the conducting material of the conducting sheath comprises copper;
- each strand of the electric cable comprises a solid core of conducting material;
- said housings and said strands are configured such that each housing is able to receive at most two said strands superposed; and/or
- the tubular portion and the conducting sheath are crimped on the end section of the electric cable, such that the core of each strand comes directly into contact with the conducting sheath, while the conducting sheath comes directly into contact with the conducting member, the strands thus being placed in electrical continuity by the conducting sheath and the conducting member.

BRIEF DESCRIPTION OF THE DRAWINGS

The disclosure of the invention will now be continued with the detailed description of embodiments, given below by way of non-limiting illustration, with reference to the appended drawings. In these.

DETAILED DESCRIPTION OF EMBODIMENTS

Figure 1:
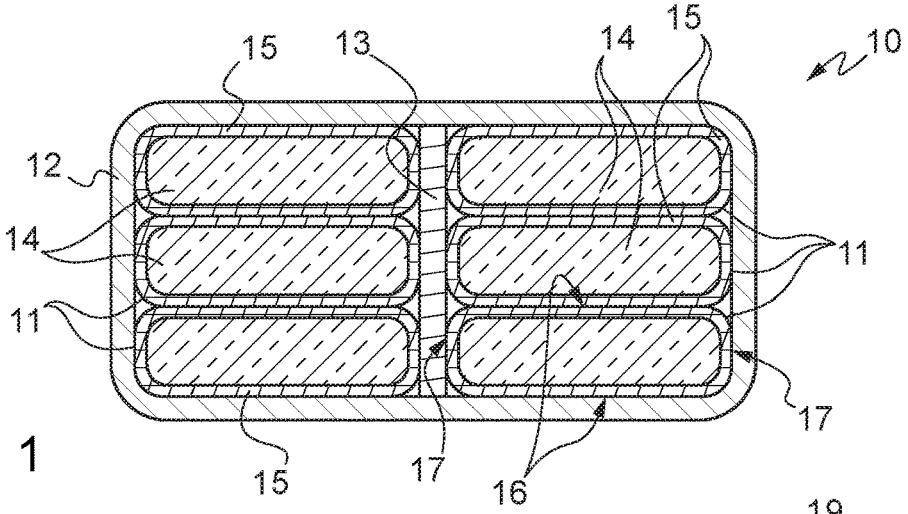
FIG. 1 shows a diagrammatic transverse cross-section of a multi-strand electric cable of which one end is to be equipped with a connection device according to the invention in order for all the strands of that cable at that end are placed at the potential of a member to which that end of the cable is to be connected.

FIG. 1 diagrammatically illustrates in transverse cross-section an electric cable 10 of which one end is to be equipped with a connection device 20 according to the invention, as shown in FIGS. 6 to 9.

The electric cable 10 comprises a plurality of strands 11, here six, and an insulating jacket 12 enveloping the strands 11. The electric cable 10 further comprises an internal partition 13 extending inside the insulating jacket 12.

The strands 11 are all identical and each comprise a core 14 of conducting material and an insulating coating 15 covering the core 14, such that the strands 11 are electrically insulated from each other.

Here, the conducting material is copper and the insulating coating 15 is insulating enamel.

The connection device 20 to install at one end of the cable 10 serves to place all the strands 11 of that cable at the potential of a member to which that end of the cable is to be connected. For this, as explained below, at the end concerned the device 20 places the strands 11 of the cable 10 in electrical continuity.

In the cable 10, the strands 11 are disposed in two rows located on opposite sides of the internal partition 13.

The cable 10 here is a winding cable, provided to be wound on a winding mounting. The subdivision of the cable 10 into a plurality of strands 11 insulated from each other makes it possible, as is known, to limit the increase in the impedance of the cable 10 due to the "skin" effect arising when the cable 10 is passed through by a high-frequency current. In order for each strand 11 (which has the same length as the other strands 11) to form the same number of turns as the other strands 11 once the cable 10 has been wound onto the winding mounting, the strands 11 are, thanks to the construction of the cable 10, continuously transposed along that cable, from one row to the other. Such a cable 10 is commonly designated by the name Continuously Transposed Conductors.

For example, the strand 11 which is seen at the top right in FIG. 1 is transposed above the strand 11 which can be seen at top left while the strand 11 which can be seen at bottom left is transposed under the strand 11 which can be seen at bottom right, and so on.

The insulating jacket 12 is formed here from insulating paper. Its nature determines in particular the dielectric properties of the cable 10.

Each strand 11, like its conducting core 14, has a flattened shape in cross-section, here substantially rectangular, and has two opposite large faces 16 and two opposite small faces 17 extending from one to the other of the large faces 16.

A description will now be given of the connection device 20 with reference to FIGS. 2 to 9.

The connection device 20 is here a connecting terminal to be crimped comprising a conducting member 31 and a conducting sheath 21 (FIGS. 6 to 9) here formed from a plurality of sleeves 22 which are identical here. Each sleeve 22 is configured to receive a strand 11 of the end section of the cable 10 which is stripped, that is to say that the insulating jacket 12 has been removed from the end section.

Figure 2:
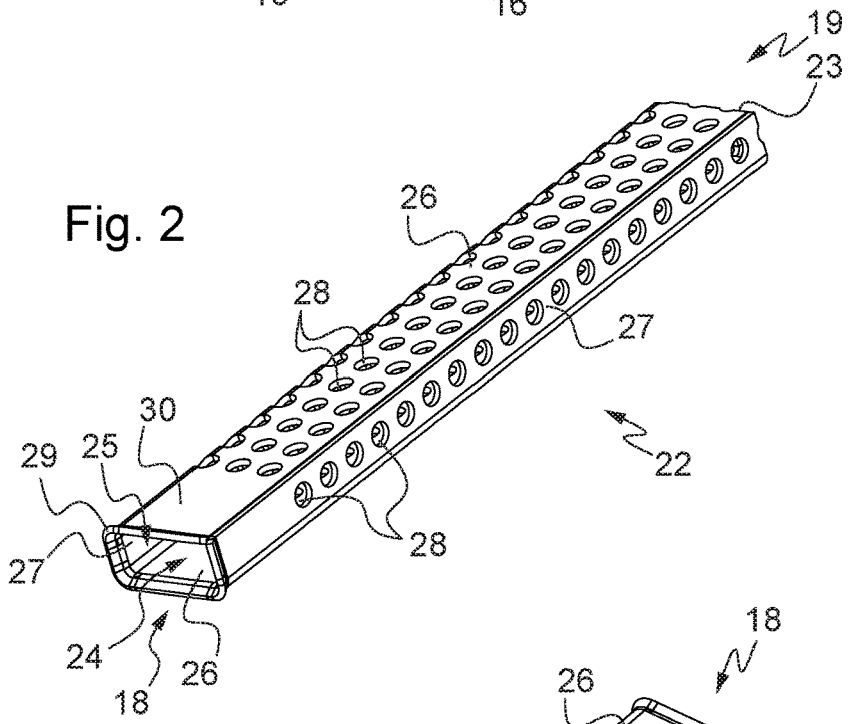
FIG. 2 is an isolated perspective view of a sleeve of a conducting sheath comprised by the connection device according to the invention.
Figure 3:
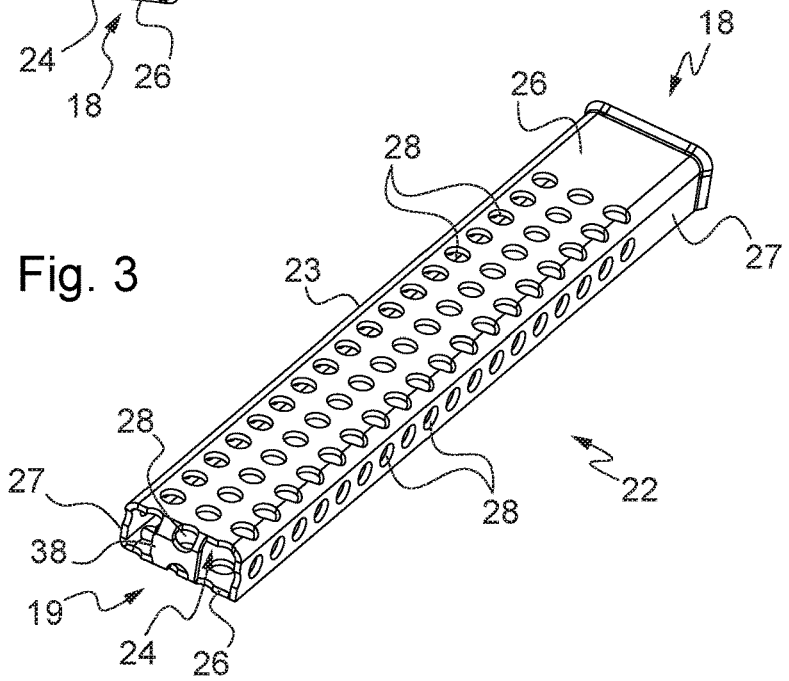
FIG. 3 is a similar view to FIG. 2, but with the sleeve seen from another angle.

FIGS. 2 and 3 show a sleeve 22 in detail.

Each sleeve 22 is an elongate tubular member of substantially rectangular cross-section comprising a wall 23 of conducting material delimiting an internal space or housing 24, provided to receive a strand 11 of the end section of the cable 10.

The conducting material of the wall 23 is here of a copper-based material, more specifically brass.

The wall 23 comprises two main longitudinal portions 26 extending facing each other and two lateral longitudinal portions 27 extending facing each other and extending from one to the other of the main longitudinal portions 26. In cross-section, the main longitudinal portions 26 form the large sides of the rectangle while the lateral longitudinal portions 27 form the small sides of the rectangle.

The sleeve 22 extends longitudinally between a first end 18 and a second end 19.

At its first end 18, the sleeve 22 has an opening 25 for insertion of a strand 11 extending from one to the other of the main longitudinal portions 26 and lateral longitudinal portions 27, and opening into the housing 24.

The opening 25 is delimited by a portion 29 of the wall 23 which is inwardly convergent, this convergent portion 29 playing the role of a guide to facilitate the insertion of the strand 11 of the end section of the cable 10.

It is to be noted here that the core 14 of the strand 11 is solid, that is to say that it forms a single block (and is not composed of a plurality of small wires).

At its second end 19, the sleeve 22 has a stop 38, formed by a continuation of a portion of the wall 23 projecting here from one of the main longitudinal portions 26 and extending opposite the housing 24.

In the wall 23 there are provided a plurality of perforations 28 each opening into opposite sides of the latter, that is to say both in the housing 24 and outside the sleeve 22. The perforations 28 are provided on each of the main 26 and lateral 27 portions. The perforations 28 are provided over practically the whole of the sleeve 22, only a portion 30 close to the end 18 is free of perforations.

The perforations 28 are disposed according to a predetermined regular pattern, here a grid, and all have a predetermined contour, here circular.

To manufacture the sleeve 22, there is provided a perforated metal sheet of predetermined thickness in which a blank (not illustrated) is cut out, and from which the wall 23 is obtained by folding.

Figure 4:
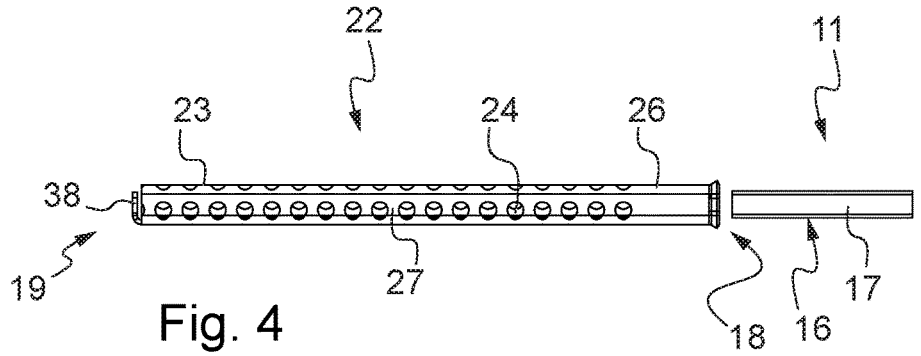
FIG. 4 is a side view of the sleeve and of a strand of the end section of the cable, ready to be inserted into the sleeve.
Figure 5:
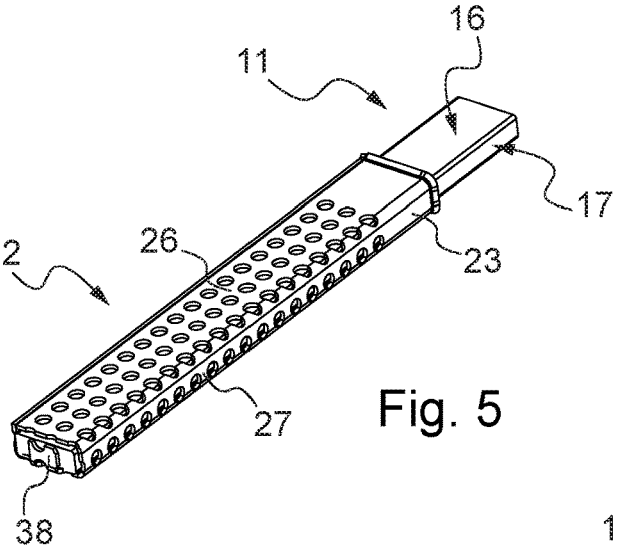
FIG. 5 is a similar view to FIG. 4, but in perspective and with the strand of the end section of cable inserted into the sleeve.
Figure 6:
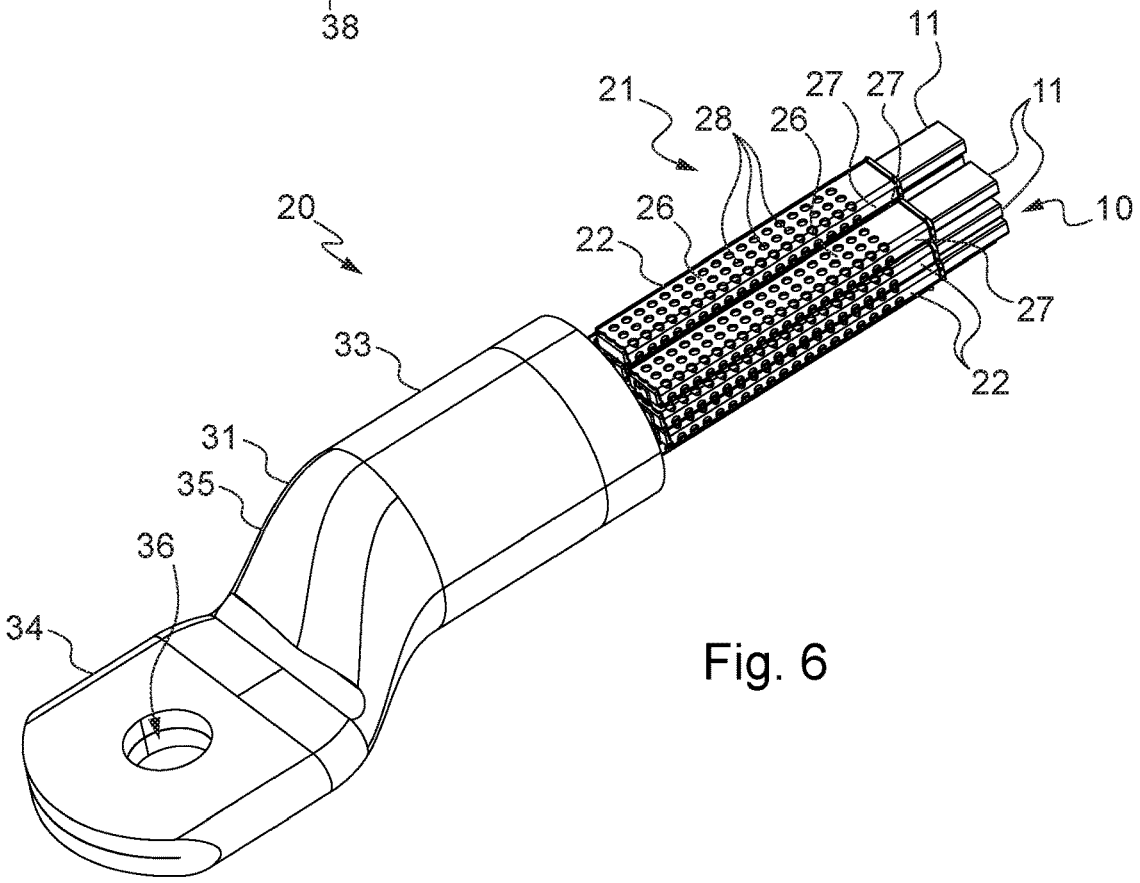
FIG. 6 is a perspective view of the conducting sheath of the connection device according to the invention and of a conducting member further comprised by that connection device, the sheath comprising a plurality of sleeves identical to that illustrated in FIGS. 2 to 5, and being ready to be inserted with the end section of cable into a tubular portion of the conducting member, each sleeve receiving a strand of the end section of the cable.

FIGS. 4 and 5 show the sleeve 22 and a strand 11 of the end section of the cable 10, respectively before and after the insertion of that strand 11 in the sleeve 22.

In order to be able to individually separate one strand 11 from the other strands 11 of the end section of the cable 10, the end section is first of all stripped, that is to say that the insulating jacket 12 is removed at that location.

The individualized strand 11 is then disposed in the housing 24 of the sleeve 22, by inserting it through the opening 25, and by pushing it into the housing 24 until it comes into contact with the stop 38.

It will be noted that the housing 24 has in cross-section a rectangular shape configured such that the strand 11, it too of substantially rectangular shape, is received with a close fit in the sleeve 22. In other words, the portion of the strand 11 received in the sleeve 22 is in contact with, or at least in immediate proximity to, by the whole of its periphery, each of the main 26 and lateral 27 longitudinal portions of the wall 23 as well as with the stop 38.

A description will now be given with reference to FIGS. 6 to 9 of the conducting member 31 and the conducting sheath 21 comprised by the connection device 20, which here is a connecting terminal to be crimped.

The conducting member 31 comprises a tubular portion 33 linked to a flat portion 34 by a transition portion 35. The tubular portion 33 has an opening located remotely from the flat portion 34 and which opens into an internal space of the tubular portion 33.

The flat portion 34 is a contact pad of parallelepiped general shape. It has an aperture 36 configured to receive a threaded rod belonging to an electrical connection terminal (not shown) for example provided with a mounting collar. To provide the electrical contact between the terminal and the connecting terminal 20, the flat portion 34 is clamped between the mounting collar and a nut screwed onto the threaded rod.

The tubular portion 33 has a uniform outside diameter over the whole of its length.

For more detail concerning the conducting member 31, reference may be made to French patent application 2 947 960, which describes a connecting terminal to be crimped of which the conducting member is similar to the conducting member 31.

In contrast to the connection device described in that document, in which the conducting sheath is formed by an insert having a single housing, the conducting sheath 21 comprised by the connection device 20 has a plurality of housings 24 each delimited by a sleeve 22.

The conducting sheath 21 is formed here by six sleeves 22. The conducting sheath 21 thus comprises the same number of sleeves 22 as the number of strands 11 comprised by the cable 10; and comprises the same number of housings 24 as sleeves 22.

As can be seen in FIGS. 6 to 9, in the sheath 21 each sleeve 22 neighbors at least one other sleeve 22 such that the housing 24 of each sleeve 22 is separated from the housing 24 of the neighboring sleeve by the wall 23 of that sleeve 22 and by the wall 23 of the neighboring sleeve 22.

To insert the end section of the cable 10 in the sleeves 22, the end section is stripped in advance and the strands 11 are inserted one after the other into a respective sleeve 22 as explained earlier.

The end section of the cable 10 provided with the sheath 21 formed by the sleeves 22 is then disposed in the tubular portion 33, through the opening, and the tubular portion 33 is crimped, in known manner, in a crimping device (not illustrated) comprising a pair of jaws.

For more detail on the crimping device, reference may be made to French patent application 2 947 960 or to French patent application 2 995 459.

Under the effect of the coming together of these jaws, each sleeve 22 then comes into contact with the strand 11 disposed in its housing 24, the coating 15 embeds itself through the perforations 28 until it breaks, which enables a direct contact between the core 14 of the strand 11 and the sleeve 22 and thus a good electrical contact.

It will be observed (see FIGS. 8 and 9) that the crimped portion is formed with a B-shaped cross-section. Such a crimping cross-section has the advantage of enabling compliance verification merely by measuring the thickness of the crimped portion.

Figure 7:
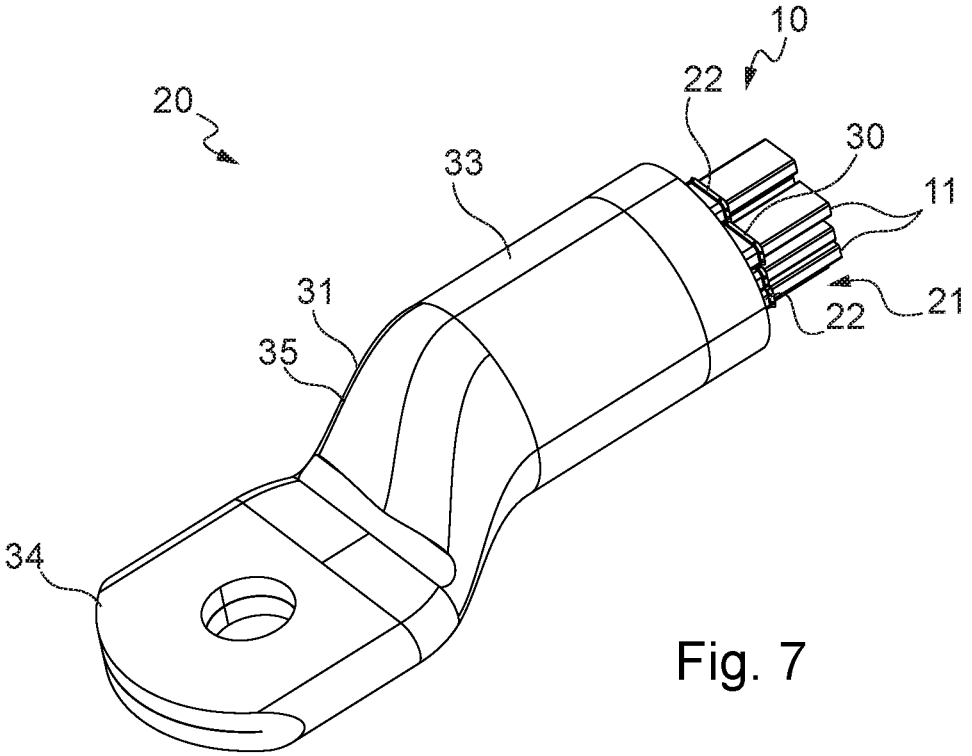
FIG. 7 is a similar view to FIG. 6, the conducting sheath receiving the end section of the cable and being disposed in the tubular portion.
Figure 8:
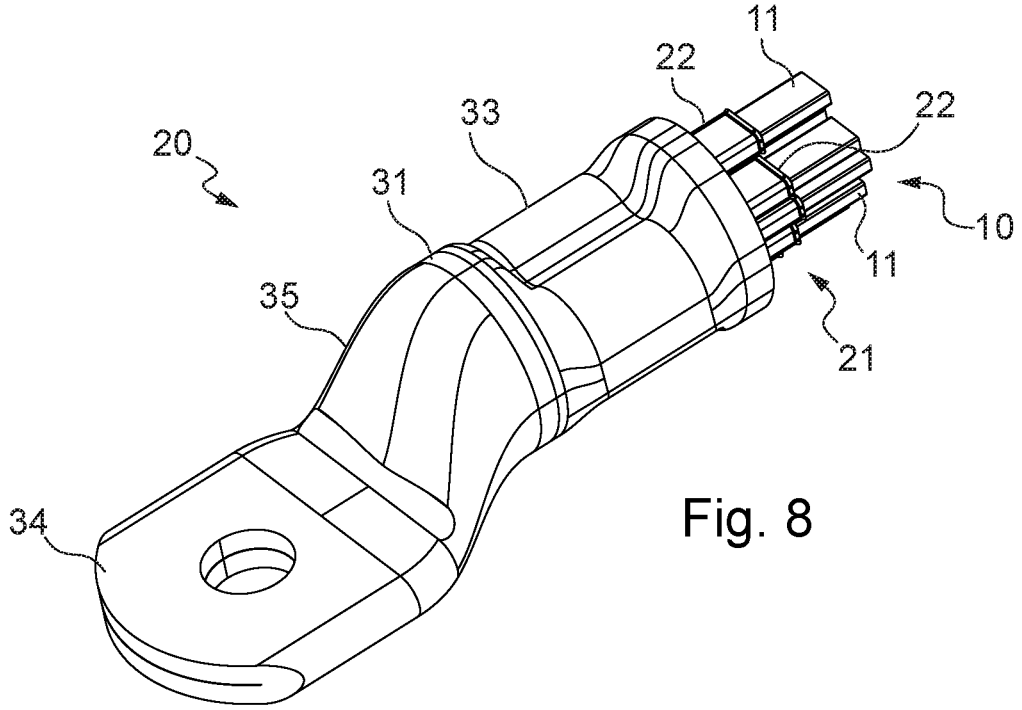
FIGS. 8 and 9 are similar views to FIG. 7, respectively showing in perspective and in side elevation the connection device after crimping.
Figure 9:
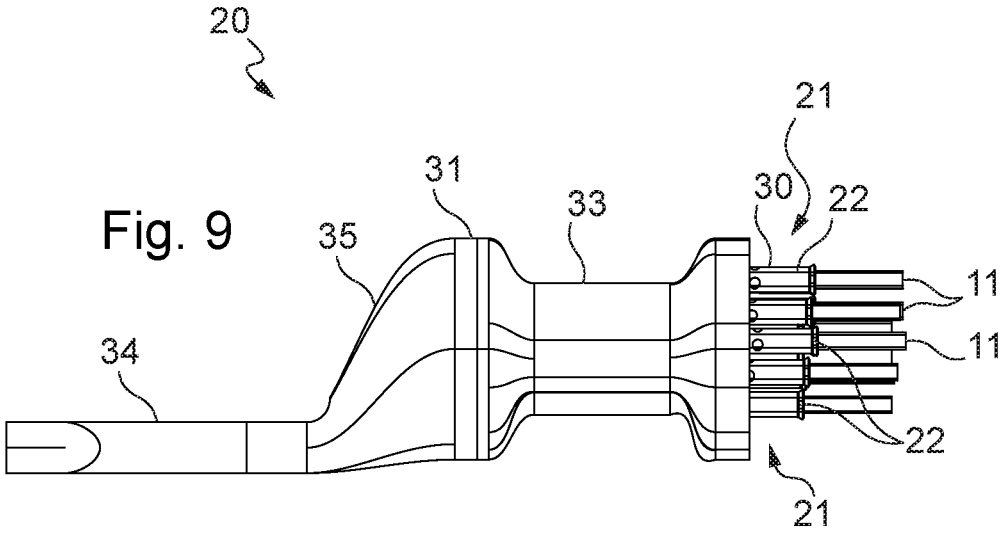

It will be noted that the end section of the cable 10 and the sheath 21 are pushed into the tubular portion 33 to a depth such that the portion 30 of each sleeve 22 is partially outside the tubular portion 33, whereas the part of the sleeve 22 over which are provided the perforations 28, that is to say the major part of the sleeve 22, is practically entirely received in the tubular portion 33 (FIG. 7). After crimping, on account of the deformation of the material, the portions 30 and/or the perforated parts of the sleeves 22 may protrude further outside the tubular portion 33.

It is to be noted here that in order to be able to deform the insulating coating 15 and the core 14 of each strand 11 at the time of the crimping, the wall 23 is made from a harder conducting material than the material of the insulating coating 15 and than the conducting material of the core 14 of each strand 11.

It will furthermore be noted that at the time of crimping, the sleeves 22 are pressed against each other and/or against the conducting member 31.

Thus, electrical continuity is created between all the sleeves 22 and the conducting member 31.

Through the intermediary of the sleeves 22 and the conducting member 31, there therefore exists electrical continuity between the cores 14 of each of the strands 11. Therefore, the strands 11, which were initially electrically insulated from each other, are placed in electrical continuity by the conducting member 31 and by the sheath 21 formed by the sleeves 22.

It will be noted that since each strand 11 enters into contact by the whole of its periphery with each of the main 26 and lateral 27 longitudinal portions of the sleeve 22 in which it is received, the insulating coating 15 is broken over the whole of the periphery of the strand 11, which promotes good electrical contact.

Figure 10:
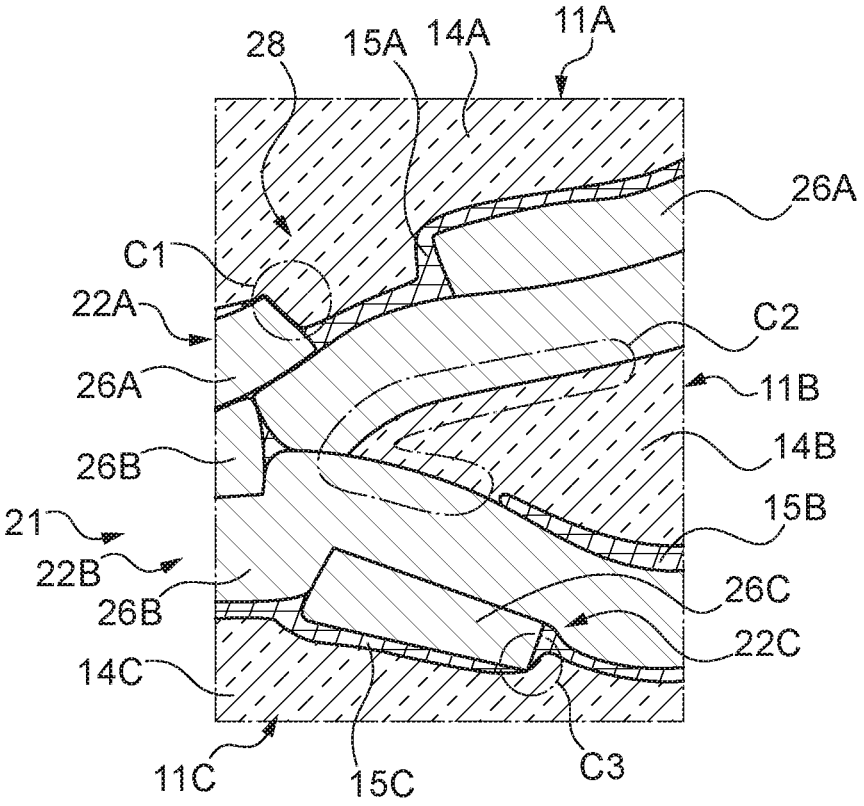
FIG. 10 is a detail view of a cross-section of the zone of the connection device which contains the end portion of the cable, this cross-section being transversely oriented and made in the zone deformed by the crimping, in the midst of this zone in the longitudinal direction.

FIG. 10 is a detail view of a cross-section of the crimped portion, this cross-section being transversely oriented and made in the midst of that portion in the longitudinal direction.

In this detail view can be seen three strands 11A, 11B and 11C placed in electrical continuity via the sheath 21, and more specifically by the sleeves 22 in which they are received. These sleeves 22 are in contact here by their respective main longitudinal portions 26.

In this FIG. 10 can in particular be seen a first contact zone C1 between the core 14A of the strand 11A and the main portion 26A of its sleeve 22A; a second contact zone C2 between the core 14B of the strand 11B and each of the main portions 26B of its sleeve 22B, which main portions 26B moreover come into contact with each other; and a third contact zone C3 between the core 14C of the strand 110 and the main portion 26C of its sleeve 22C.

In zone C1, the core 14A of the strand 11A is embedded in a perforation 28 of the main portion 26A, which has broken the coating 15A and enabled the direct contact between the core 14A and the sleeve 22A.

In zone C3, in similar manner, the core 14C of the strand 11C is embedded in a perforation of the main portion 26C, which has broken the coating 15C and enabled the direct contact between the core 14C and the sleeve 22C.

In zone C2, it will be noted that the coating 15B has been not only broken by also driven along the surface of the core 14B of the strand 11B, leaving exposed a large part of the core 14B, which is in direct contact with the sleeve 22B. In this connection it will be observed that the cross-section shown in part in FIG. 10 was made in a zone of deformations of particularly great magnitude since this cross-section is made in the midst of the zone deformed in the longitudinal direction.

It will be noted that at the exit of the perforations 28, the wall 23 has sharply-angled edges which promote the breaking of the coating 15.

Figure 11:
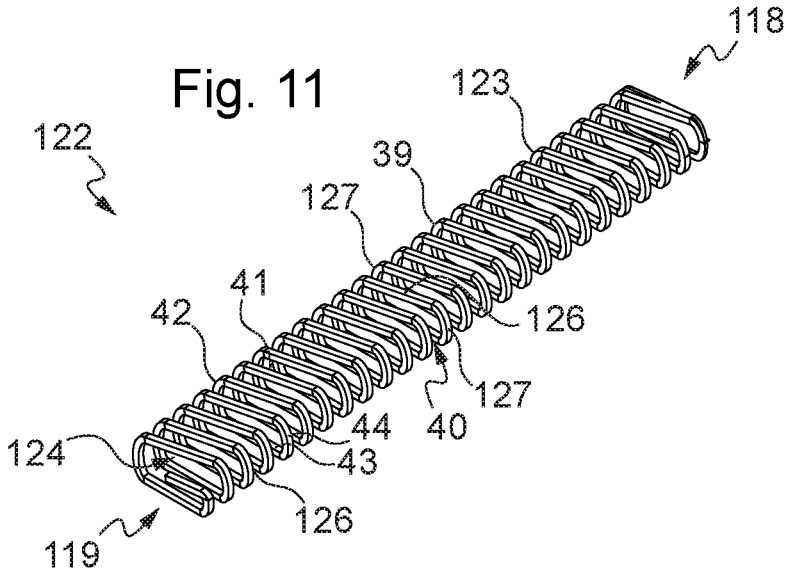
FIGS. 11 and 12 are similar views to FIGS. 3 and 5 respectively, but for a variant of the sleeves of the conducting sheath.
Figure 12:
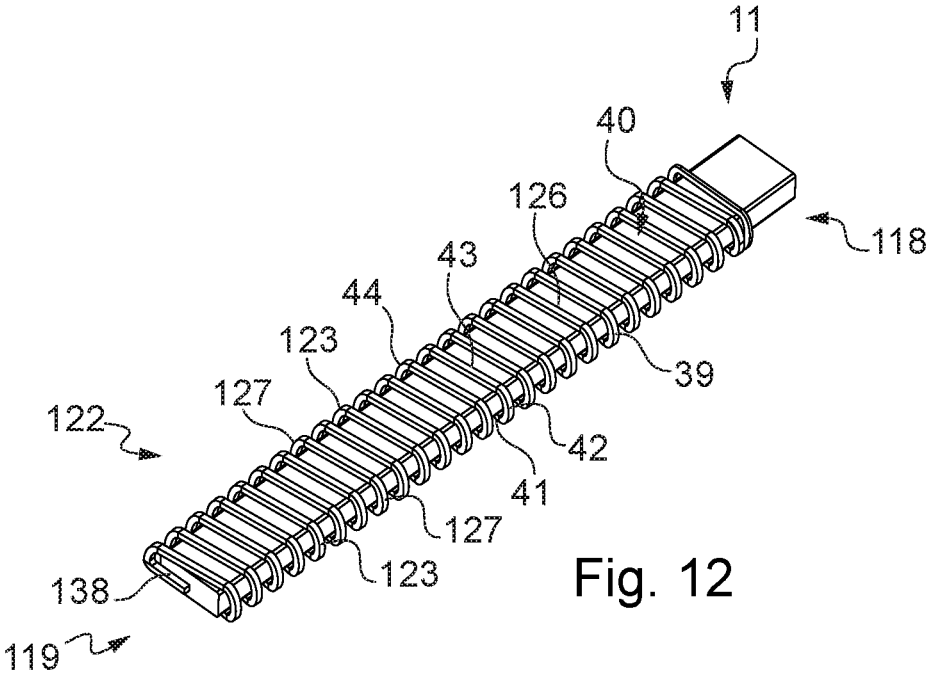
Figure 13:
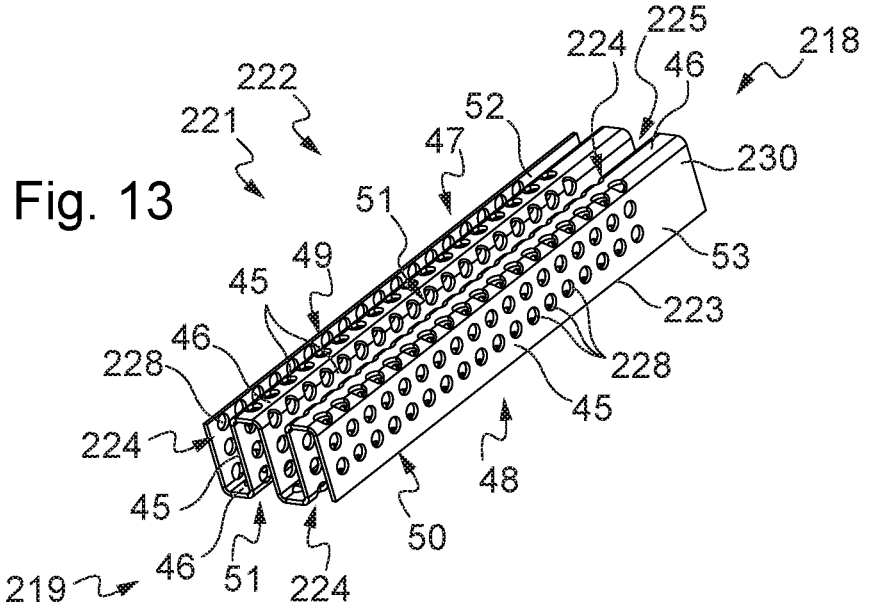
FIGS. 13 and 14 are views respectively in perspective and at the tip of a structure comprised by a variant of the conducting sheath.
Figure 14:
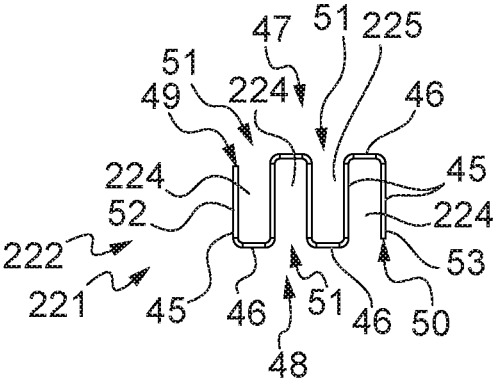

With reference to FIGS. 11 and 12 a description will now be given of a variant 122 of the sleeve 22.

In the following description, the same numerical references are adopted for parts that are similar between the sleeve 122 and the sleeve 22, but with the number 100 added.

In this variant, the wall 123 of the sleeve 122 is not obtained from a metal sheet that is perforated and folded but from a metal wire 39 which is helically-wound, here with a predetermined pitch.

Each turn of the wire 39 successively presents a first straight portion 41, a first curved portion 42, a second straight portion 43 and a second curved portion 44. The first straight portions 41 together form one of the main longitudinal portions 126 of the wall 123, while the second straight portions 43 together form the other of the main longitudinal portions 126 of the wall 123. The first curved portions 42 together form one of the lateral longitudinal portions 127 of the wall 123, while the second curved portions 44 together form the other of the lateral longitudinal portions 127 of the wall 123.

At its second end 119, the sleeve 122 has a stop 138, formed by an end portion of the metal wire 39 extending opposite the housing 124.

The metal wire 39 delimits an opening in the form of a helicoidal strip 40 which extends continuously from the first end 118 to the second end 119 of the sleeve 122. The opening 40 opens on opposite sides of the wall 123, that is to say both into the housing 124 and to the outside of the sleeve 122.

On crimping, the coating 15 penetrates into the opening 40 and breaks along the wire 39 which may then enter into contact with the core 14.

It will be noted that the sleeves 22 and 122 have a wall 23 or 123 which is apertured in a manner distributed according to a predetermined solid-hollow pattern.

For the sleeves 22, the perforations 28 are distributed over the whole wall 23 except on its portion 30 located in the neighborhood of the end 18; and the wall 23 is apertured according to the solid-hollow grid arrangement pattern of the perforations 28.

For the sleeve 122, the opening 40 is distributed over the whole wall 123, which is apertured according to the solid-hollow pattern given by the pitch of the helical winding of the wire 39 and by the width of that wire.

With reference to FIGS. 13 to 16 a description will now be given of a structure 222 comprised by a sheath 221 which is a variant embodiment of the sheath 21. In the following description, the same numerical references are adopted for parts that are similar between the structure 222 and the sleeve 22, but with the number 200 added.

The structure 222 is configured to receive four strands 11 of the end section of the stripped cable 10.

The structure 222 is an elongate member of specific cross-section extending longitudinally between a first end 218 and a second end 219. The structure 222 has a first longitudinal side 47 and a second longitudinal side 48, which is an opposite side to the first opposite side 47.

The structure 222 comprises a wall 223 with a straight zig-zag profile, that is to say a zig-zag of which the limbs are parallel and the points replaced by a segment that is transverse to the limbs.

Here the profile of the wall 223 has five limbs and thus delimits four housings 224, disposed in a row, each provided to receive a strand 11 of the end section of the cable 10.

The wall 223 extends between a first longitudinal edge 49 extending along the first longitudinal side 47 of the structure 222 and a second longitudinal edge 50, which is an opposite edge to the first longitudinal edge 49, extending along the second longitudinal side 48 of the structure 222.

The wall 223 has first longitudinal portions 45 extending substantially parallel to each other and in register with respect to each other, and second longitudinal portions 46 extending transversely to the first longitudinal portions 45 and each connecting two neighboring first longitudinal portions 45.

The first longitudinal portions 45 each extend from one to the other of the first and second longitudinal sides 47 and 48 of the structure 222. The second longitudinal portions 46 each extend along a respective longitudinal side 47 or 48, two longitudinal portions 46 connected to a same first longitudinal portion 45 extending respectively along the two longitudinal sides 47 and 48.

The first longitudinal portion 45 extending from the first longitudinal edge 49 of the wall 223 here forms a first end wall 52, while the first longitudinal portion 45 extending from the second longitudinal edge 50 of the wall 223 here forms a second end wall 53.

Each housing 224 is delimited by two neighboring first longitudinal portions 45 and by the second longitudinal portion 46 connecting those two first longitudinal portions 45. The housing 224 has a longitudinal opening 51 extending facing the second longitudinal portion 46 delimiting that housing and opening on the opposite longitudinal side 47 or 48 of the structure 222 to that second longitudinal portion 46.

The openings 51 of the housings 224 open alternately on one of the first and second longitudinal sides 47 or 48, then on the other of the first and second longitudinal sides 47 or 48 of the structure 222. In other words, the openings 51 of two neighboring housings 224 of the column open respectively on one and on the other of the longitudinal sides 47 and 48 of the structure 222.

It will be noted that the first end wall 52 and the second end wall 53 each delimit a single respective housing 224; while the first longitudinal portions 45 located between these end walls 52 and 53 each delimit two neighboring housings 224. More specifically, each longitudinal portion 45 has a first face delimiting one of the housings 224 and a second face, which is an opposite face to the first face, delimiting the neighboring housing 224. The first longitudinal portions 45 thus separate two distinct housings 224 from each other.

At its first end 218, the structure 222 furthermore has openings 225 that each open into a respective housing 224 and extend from one to the other of the first longitudinal portions 45 delimiting that housing 224, as well as from the second longitudinal portion 46 delimiting that housing 224, to its opening 51.

At its second end 219, the structure 222 has openings that are similar to the openings 225.

As a variant, stops similar to the stop 38 of the sleeve 22 extend opposite the housings 224 to limit the insertion of the strands 11 of the cable 10.

The structure 222 furthermore has a plurality of perforations 228 provided in the wall 223 and which are similar to the perforations 28 provided in the wall 23 of the sleeve 22.

The structure 222 furthermore has a portion 230 free of perforations, which is similar to the portion 30 of the sleeve 22.

The structure 222 is manufactured in the same way as the sleeve 22, that is to say starting from a metal sheet which is perforated and folded.

Figure 15:
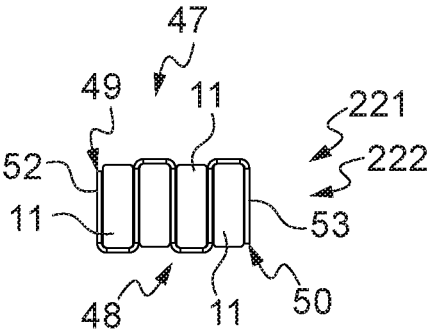
FIGS. 15 and 16 are similar views to FIGS. 14 and 13 respectively, but with strands of an end section of cable received in the structure.
Figure 16:
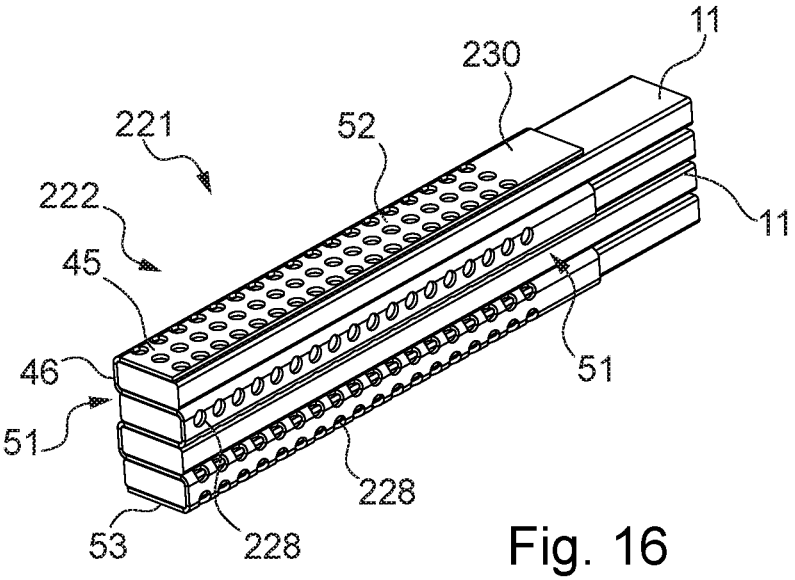
Figure 17:
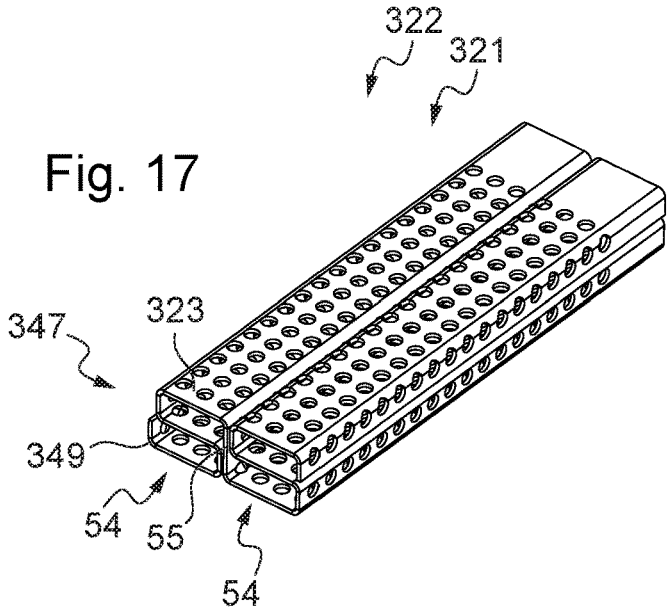
FIGS. 17 to 20 are similar views to FIGS. 13 to 16 respectively, but for another variant of the conducting sheath.
Figure 18:
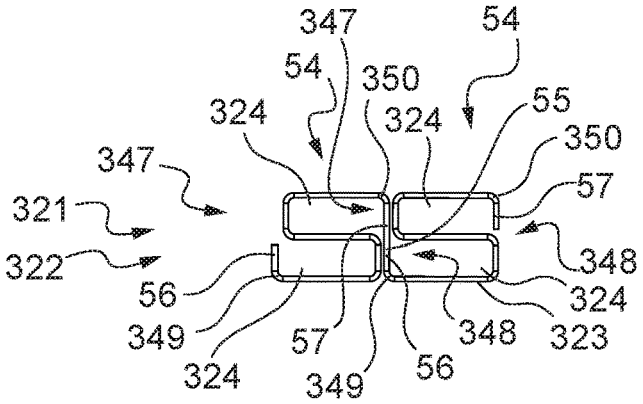
Figure 19:
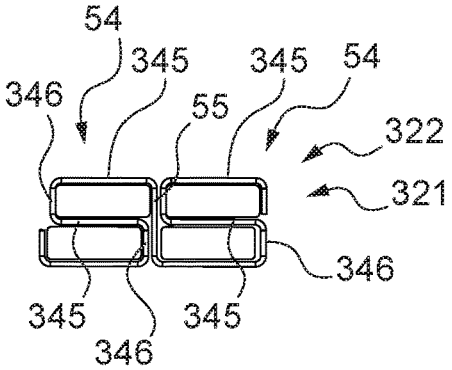
Figure 20:
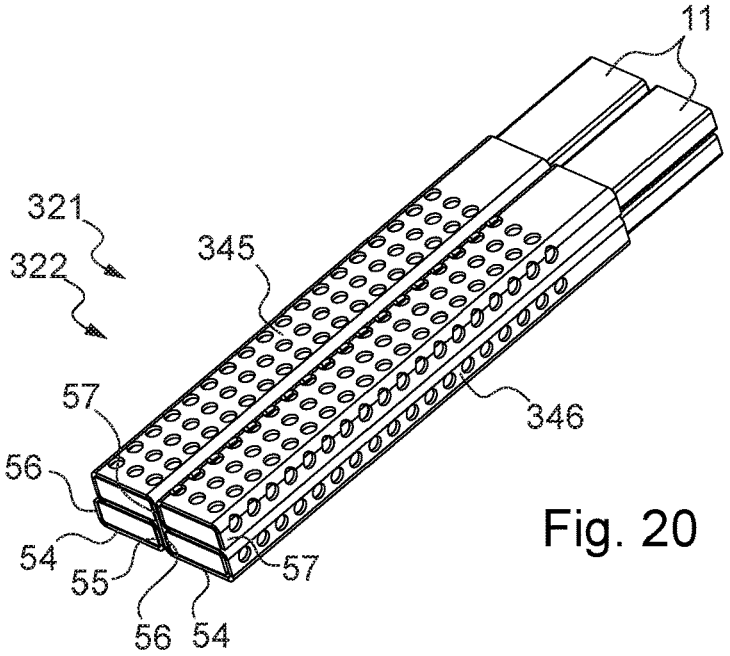

FIGS. 15 and 16 show the structure 222 with a strand 11 inserted into each of the housings 224.

The strands 11 are inserted into the housings 224 through openings 225 or 51.

With reference to FIGS. 17 to 20 a description will now be given of a structure 322 comprised by a sheath 321 which is another variant embodiment of the sheath 21. In the following description, the same numerical references are adopted for parts that are similar between the structure 322 and the structure 222, but with the number 100 added, except for the references 45 to 51 for which the number 300 is added.

The structure 322 is similar to the structure 222, except that the wall 323 has two parts 54 of straight zig-zag shaped cross-section and a junction wall 55 connecting the two parts 54.

Each part 54 delimits two housings 324 such that the structure 322 has four housings 324 disposed in two adjacent rows, each part 54 delimiting two neighboring housings 324 of a row.

In each part 54, the wall 323 extends between a first longitudinal edge 349 extending along a first longitudinal side 347 of the part 54 and a second longitudinal edge 350, which is an opposite edge to the first longitudinal edge 349, extending along a second longitudinal side 348 of the part 54.

The wall 323 furthermore has, for each part 54, a first side wall 56 transversely continuing the part 54 from its first longitudinal edge 349 by extending along the first longitudinal side 347; and a second side wall 57 transversely continuing the part 54 from its second longitudinal edge 350 while extending along the second longitudinal side 348.

The side wall 56 is configured to close the longitudinal opening of the housing 324 that opens on the first longitudinal side 347, that is to say that this wall 56 delimits the housing 324. The second side wall 57 is configured to close the longitudinal opening of the housing 324 that opens on the second longitudinal side 348, that is to say that this wall 57 delimits the housing 324.

The second side wall 57 of one of the parts 54 connects to the first side wall 56 of the other of the parts 54 so as to form together the junction wall 55. The junction wall 55 is located between the two parts 54 and delimits a housing 324 with each of the parts 54.

It will be noted that in each part 54, a first longitudinal portion 345 separates two neighboring housings 324 of a row.

Two neighboring housings 324 each belonging to one of the two rows are separated from each other by the junction wall 55 and by a second longitudinal portion 346 which extends along the junction wall 55.

As a variant, the structure 322 is replaced by a similar structure but delimiting more than two housings 324 per row, with possibly the side walls 56 and 57 which are longer so as to close the openings 351 of several housings 324 of a row; or similarly the structure 222 is replaced by a similar structure but in which the number of housings such as 224 is different from four, with possibly the first and second longitudinal edges 49 and 50 extending from the same longitudinal side 47 or 48.

As a variant, the conducting sheath 221 or 321 is replaced by a similar sheath but comprising several structures such as the structure 222 or 322, according to the number of strands 11 which the cable 10 comprises, for example between two and twenty structures 322; or similarly the conducting sheath such as 21 is replaced by a similar conducting sheath but comprising a number of sleeve such as 22 or 122 different from six, for example between five and eighty-four.

As a variant, the conducting sheath comprises at least two different structures, for example a sleeve 22 or 122 and a structure 222 or 322.

In variants not shown:

- the wall of the sleeves and/or of the structure is made differently than by a perforated and folded sheet or than by a helically wound wire, for example by a trellis of metal wires, comprising longitudinally oriented warp wires and transversely oriented weft wires, in a rectangular loop formation, that are regularly disposed along the warp wires and attached thereto, or else by a metal trellis made otherwise than with wires, for example by additive manufacture;
- the conducting sheath is apertured according to a different solid-hollow pattern than a grid arrangement of perforations, of the width of a wire and of its helical winding pitch, or than the mesh of a trellis of wires, for example a staggered perforation arrangement;
- the housings such as 24, 124, 224 or 324 have a different profile than rectangular, for example circular or oval in order to receive cable strands having such a cross-section; and/or
- the conducting material of which the sheath is made is different from brass, for example stainless steel, nickel or of another copper alloy such as a copper-nickel alloy.

In each of the illustrated examples, each housing 24, 124, 224 or 324 is configured to receive a single strand of the cable 11. In variants not illustrated, the housing such as 24, 124, 224 or 324 is configured to receive at most two superposed strands 11, each strand 11 being in direct contact with the wall such as 23, 123, 223 or 323.

It will be noted that in each of the examples described and represented, the wall such as 23, 123, 223 or 323 has a longitudinal orientation in the connection device 20, that is to say that it is oriented in the longitudinal direction of the tubular portion 33 of the conducting member such as 31.

In each of the illustrated examples, the longitudinal portions of cable received in the sheath such as 21, 221 or 321 are strands comprising a solid core covered with an insulating coating. In variants not illustrated, the longitudinal portions are different from such a strand, for example parts of the core of a cable formed by multiple fine wires, for example of aluminum.

Numerous other variants are possible according to circumstances, and in this connection it is to be noted that the invention is not limited to the examples described and shown.

The invention claimed is:

1. A connection device to crimp on an end section of electric cable, the connection device comprising:

a conducting member having a tubular portion and comprising a conducting sheath apertured according to a predetermined solid-hollow pattern, said tubular portion and said sheath being configured in order for the sheath to be disposed inside the tubular portion with the end section disposed inside the sheath and in order for the tubular portion and the sheath to be able to be crimped on the end section, the sheath comprising at least one longitudinal wall separating two distinct housings each configured to receive a respective longitudinal portion of said end section of cable.

2. The device according to claim 1, wherein the at least one longitudinal wall includes at least two longitudinal walls each forming a sleeve delimiting a said housing, each sleeve neighboring another sleeve in said sheath such that the housing of each sleeve is separated from the housing of the neighboring other sleeve by the longitudinal wall of the sleeve and by the longitudinal wall of the neighboring other sleeve.

3. The device according to claim 1, wherein the at least one longitudinal wall includes one longitudinal wall forming a structure delimiting the two housings, which are separated from each other by a portion of said longitudinal wall.

4. The device according to claim 3, wherein said longitudinal wall is shaped such that the housings are disposed in at least one row.

5. The device according to claim 3, wherein said one longitudinal wall is shaped such that the housings are disposed in several adjacent rows.

6. The device according to claim 1, wherein each housing extends longitudinally between a first end where the sheath has at least one opening for insertion of the respective longitudinal portion of said end section of cable, and a second end, which is an opposite end to the first end, where the sheath has a stop configured to limit the pushing-in of the longitudinal portion of the end section of cable into the housing.

7. The device according to claim 1, wherein said longitudinal wall is a metal sheet that is perforated according to a predetermined pattern, cut out and folded.

8. The device according to claim 1, wherein said longitudinal wall is a helically wound metal wire.

9. The device according to claim 1, wherein said longitudinal wall is a metal trellis.

10. An assembly comprising:

the connection device according to claim 1; and an electric cable comprising a plurality of strands, each of said two housings of the conducting sheath receiving a respective longitudinal portion of an end section of said electric cable comprising at least one said strand.

11. The assembly according to claim 10, wherein each strand of said electric cable is provided with a core of conducting material and with an insulating coating covering said conducting core such that the strands are electrically insulated from each other, the conducting sheath being formed from a harder conducting material than the material of the insulating coating and than the conducting material of the core of each strand, such that after crimping of the tubular portion and of the conducting sheath on the end section of the electric cable, for each strand, the core of the strand and the conducting sheath are in direct contact.

12. The assembly according to claim 11, wherein the insulating coating of the strands comprises insulating enamel, and the conducting material of the conducting sheath comprises copper.

13. The assembly according to claim 10, wherein each strand of the electric cable comprises a solid core of conducting material.

14. The assembly according to claim 10, wherein said housings and said strands are configured such that each housing is able to receive at most two said strands superposed.

15. The assembly according to claim 10, wherein the tubular portion and the conducting sheath are crimped on the end section of the electric cable, such that the core of each strand comes directly into contact with the conducting sheath, while the conducting sheath comes directly into contact with the conducting member, the strands thus being placed in electrical continuity by the conducting sheath and the conducting member.

16. The device according to claim 4, wherein said longitudinal wall is shaped such that the housings are disposed in several adjacent rows.

17. The device according to claim 2, wherein each housing extends longitudinally between a first end where the sheath has at least one opening for insertion of the respective longitudinal portion of said end section of cable, and a second end, which is an opposite end to the first end, where the sheath has a stop configured to limit the pushing-in of the longitudinal portion of the end section of cable into the housing.

18. The device according to claim 3, wherein each housing extends longitudinally between a first end where the sheath has at least one opening for insertion of the respective longitudinal portion of said end section of cable, and a second end, which is an opposite end to the first end, where the sheath has a stop configured to limit the pushing-in of the longitudinal portion of the end section of cable into the housing.

19. The device according to claim 4, wherein each housing extends longitudinally between a first end where the sheath has at least one opening for insertion of the respective longitudinal portion of said end section of cable, and a second end, which is an opposite end to the first end, where the sheath has a stop configured to limit the pushing-in of the longitudinal portion of the end section of cable into the housing.

20. The device according to claim 5, wherein each housing extends longitudinally between a first end where the sheath has at least one opening for insertion of the respective longitudinal portion of said end section of cable, and a second end, which is an opposite end to the first end, where the sheath has a stop configured to limit the pushing-in of the longitudinal portion of the end section of cable into the housing.

* * * * *